US008388356B2

(12) United States Patent
Nichols

(10) Patent No.: US 8,388,356 B2
(45) Date of Patent: Mar. 5, 2013

(54) MODULE TO CIRCUIT BOARD CONNECTOR

(75) Inventor: Robert Paul Nichols, Santa Rosa, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 304 days.

(21) Appl. No.: 12/776,892

(22) Filed: May 10, 2010

(65) Prior Publication Data

US 2011/0275227 A1 Nov. 10, 2011

(51) Int. Cl.
*H01R 12/00* (2006.01)

(52) U.S. Cl. ..... 439/65; 439/82

(58) Field of Classification Search ..... 439/65, 439/75, 81, 82, 79
See application file for complete search history.

(56) References Cited

U.S. PATENT DOCUMENTS

| | | | | |
|---|---|---|---|---|
| 6,231,402 | B1 * | 5/2001 | Kikuchi | 439/751 |
| 7,988,500 | B2 * | 8/2011 | Furukawa et al. | 439/733.1 |
| 2006/0089011 | A1 * | 4/2006 | Marshall et al. | 439/65 |
| 2009/0233466 | A1 * | 9/2009 | Lee et al. | 439/74 |

* cited by examiner

*Primary Examiner* — Tulsidas C Patel
*Assistant Examiner* — Travis Chambers

(57) ABSTRACT

A connector is provided. The connector includes contact members having a main body with a top, a bottom, a front, and a rear. A base extends from the bottom of the main body. The base is configured to be surface mounted to a first circuit board. An electrical contact extends from the front of the main body. The electrical contact is configured to be through hole mounted to a second circuit board. The connector also includes a housing having a top, a bottom, a front, and a rear. The housing has slots formed therein. The contact members are secured in corresponding slots of the housing so that the bases of the contact members are held coplanar along the bottom of the housing for mounting to the first circuit board. The electrical contacts of the contact members extend from the front of the housing for mounting to the second circuit board.

20 Claims, 6 Drawing Sheets

MODULE TO CIRCUIT BOARD CONNECTOR

BACKGROUND OF THE INVENTION

The subject matter herein relates generally to an electrical connector and, more particularly, to a connector assembly for coupling a voltage regulator module (VRM) to a circuit board.

VRM's are typically used in electronic devices to control a voltage through the device. The VRM is coupled to a circuit board, such as a motherboard, of the device to transfer power and electrical signals therebetween. Generally, a plurality of contacts are individually soldered to the VRM. The VRM is then soldered to the contacts in a position that is perpendicular to the circuit board. The individual contacts do not provide any surface for pressing the VRM onto the circuit board. Moreover, because the contacts are arranged individually, the contacts are subject to misalignment. For example, during installation of the VRM, the contacts may bend or reposition in a non-co-planar configuration; thereby creating difficultly in securing the VRM to the circuit board.

Thus, a need remains for a connector that alleviates twisting of the contacts. A need remains for a connector that provides a co-planar surface to which the VRM is coupled.

SUMMARY OF THE INVENTION

In one embodiment, a connector for interconnecting a first and a second circuit board is provided. The connector includes contact members having a main body with a top, a bottom, a front, and a rear. A base extends along the bottom of the main body. The base is configured to be surface mounted to the first circuit board. An electrical contact extends forwardly from the main body. The electrical contact is configured to be through hole mounted to the second circuit board. The connector also includes a housing having a top, a bottom, a front, and a rear. The housing has slots formed therein. The contact members are secured in corresponding slots of the housing so that the bases of the contact members are held coplanar along the bottom of the housing for mounting to the first circuit board. The electrical contacts of the contact members extend from the front of the housing for mounting to the second circuit board.

In another embodiment, a voltage regulator module (VRM) assembly is provided. The VRM assembly includes a VRM circuit board having vias and a VRM component coupled to the VRM circuit board. A connector is provided including a housing having slots formed therein. Contact members are secured in corresponding slots of the housing. Each contact member has an electrical contact being through hole mounted to a corresponding via in the VRM circuit board. Each contact member has a base that is held coplanar along a bottom of the housing for surface mounting to a motherboard.

In another embodiment, an electronic assembly is provided. The electronic assembly includes a circuit board having electrical pads. A voltage regulator module (VRM) is provided including a VRM circuit board having vias and VRM components coupled to the circuit board. A connector is provided including a housing having slots formed therein. Contact members are secured in corresponding slots of the housing. Each contact member has an electrical contact being through hole mounted to a corresponding via in the VRM circuit board. Each contact member has a base that is held coplanar along a bottom of the housing for surface mounting to a motherboard.

DETAILED DESCRIPTION OF THE DRAWINGS

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
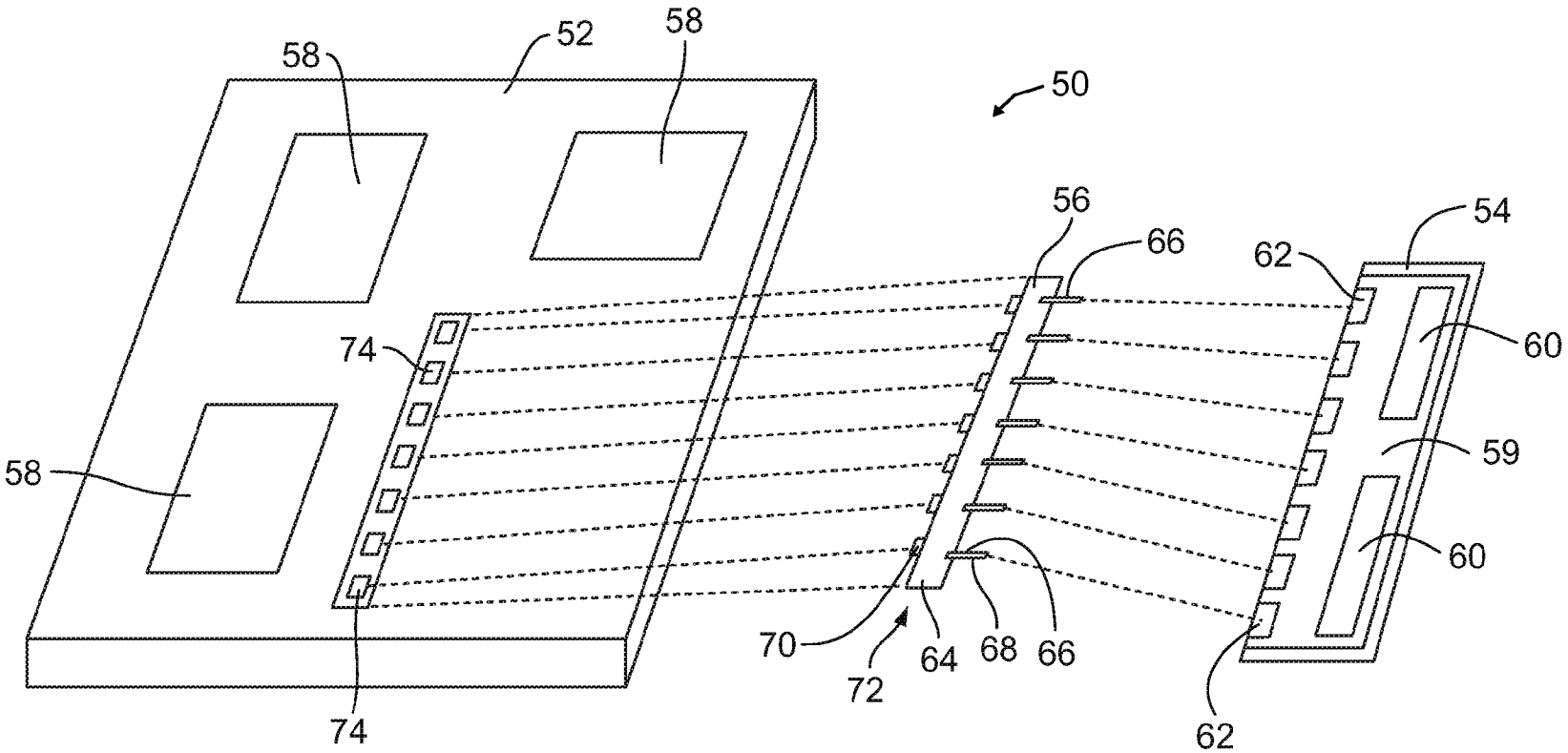
FIG. 1 is an exploded view of an electronic assembly formed in accordance with an embodiment.

FIG. 1 is an exploded view of an electronic assembly 50 having a circuit board 52, a voltage regulator module (VRM) 54, and a connector 56 that electrically interfaces the circuit board 52 and the voltage regulator module 54. Optionally, the connector 56 may be used to couple any electrical module to any circuit board, for example, a motherboard, a daughter board or the like. The circuit board 52 includes at least one electrical component 58 and electrical pads 74. The VRM 54 includes a VRM circuit board 59 and at least one voltage regulator 60 mounted to the VRM circuit board 59. The VRM circuit board 59 includes a plurality of metal-plated vias 62 proximate to an edge thereof. The connector 56 includes a housing 64 and contact members 66 secured within the housing 64. The contact members 66 include an electrical contact 68 and a base 70. Optionally, as in the illustrated embodiment, the connector 56 is used to connect the VRM 54 to the circuit board 52 such that the VRM circuit board 59 is oriented perpendicular to the circuit board 52.

The electrical contacts 68 of the connector 56 are through hole mounted to the vias 62 of the VRM 54 to secure the VRM 54 to the connector 56. The VRM 54 and the circuit board 52 are secured to the connector 56 to form an electrical interface between the VRM 54 and the circuit board 52. The electrical interface enables a transfer of power and/or data signals between the electrical components 58 and the voltage regulators 60. The bases 70 of the contact members 66 are held coplanar along a bottom 72 of the housing 64 for mounting the connector 56 to the circuit board 52. In the exemplary embodiment, the base 70 of each contact member 64 is soldered to a corresponding electrical pad 74 of the circuit board 52. The bases 70 are mounted to the electrical pads 74 so that the electrical contacts 68 are aligned in a coplanar relationship.

Figure 2:
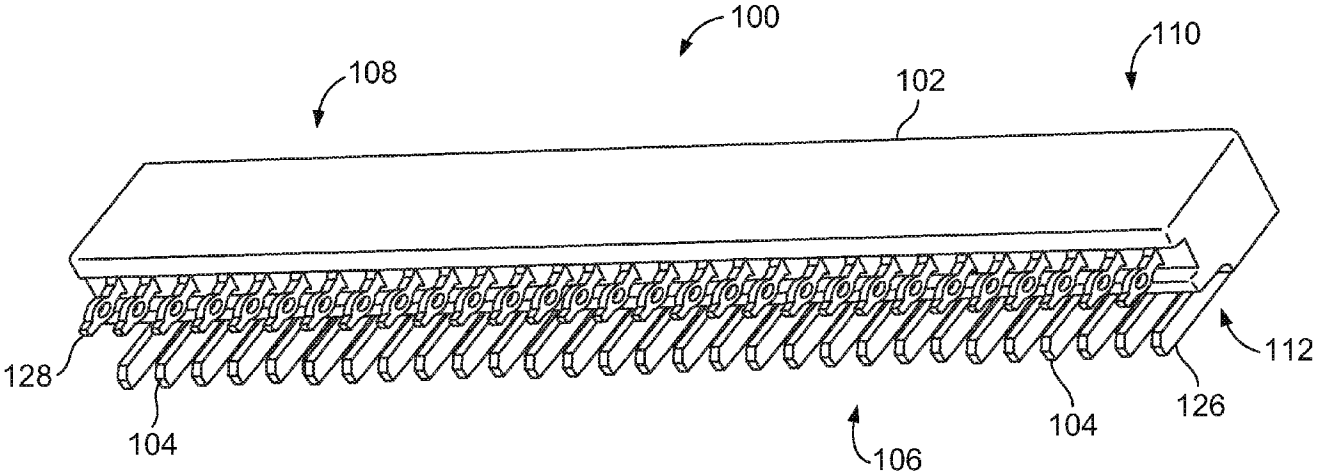
FIG. 2 is a top perspective view of a connector that may be used with the electronic assembly shown in FIG. 1.

FIG. 2 is a top perspective view of a connector 100 that may be used in place of the connector 56 shown in FIG. 1. Connector 100 has a housing 102 and a plurality of contact members 104. The connector 100 is configured to couple the VRM 54 to the circuit board 52. The housing 102 includes a front 106, a rear 108, a top 110, and a bottom 112. The contact members 104 are secured within the housing 102. A base 126 of each contact member 104 extends along the bottom 112 of the housing 102. An electrical contact 128 of each contact member 104 extends from the front 106 of the housing 102.

Figure 3:
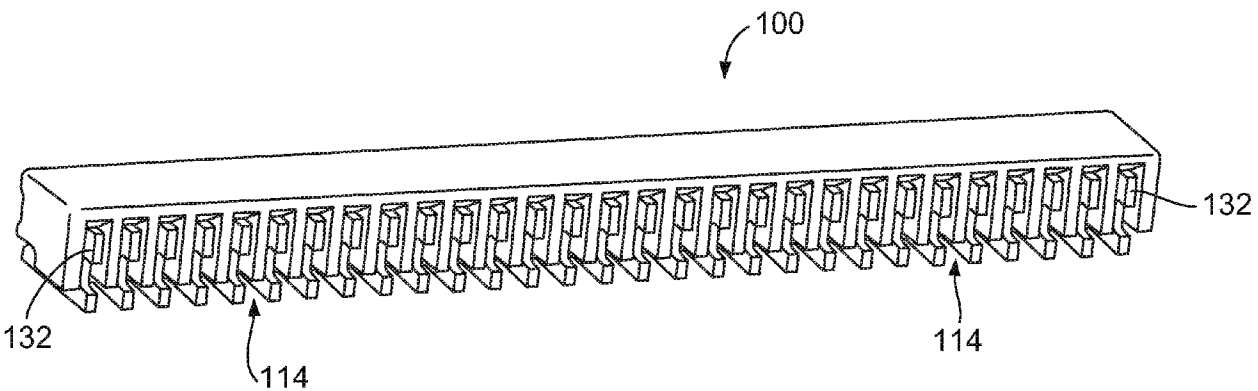
FIG. 3 is a rear perspective view of the connector shown in FIG. 2

FIG. 3 is a rear perspective view of the connector 100. The connector 100 includes a plurality of slots 114 extending therethrough. The slots 114 extend from the rear 108 of the housing 102 to the front 106 of the housing 102. The contact members 104 are secured within the slots 114 to retain each contact member 104 within the housing 102. A pressing surface 132 on contact member 104 provides a surface to insert contact member 104 into the housing 102. The pressing surface 132 of each contact member 104 extends from the rear 108 of the housing 102. The housing 102 aligns the contact members 104 in a co-planar relationship.

Figure 4:
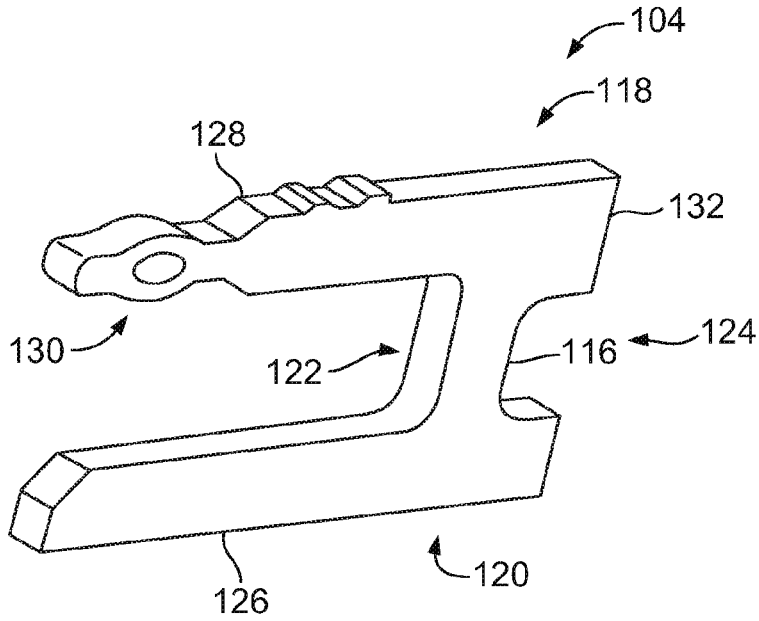
FIG. 4 is a perspective view of a contact member shown in FIGS. 2 and 3.

FIG. 4 is a perspective view of a contact member 104. The contact member 104 includes a main body 116 having a top 118, a bottom 120, a front 122, and a rear 124. The base 126 extends along the bottom 120 of the main body 116. The base 126 extends from both the front 122 and the rear 124 of the main body 116. The electrical contact 128 extends along the top 118 of, and from the front 122 of, the main body 116. Optionally, the electrical contact 128 may extend from any portion of the front 122 of the main body 116. In the exemplary embodiment, the electrical contact 128 is an eye-of-the-needle contact 130. Other types of contacts are possible in alternative embodiments. For example, the electrical contact 128 may include a pin, a socket, a spring finger, a tab, a notch, and/or any other suitable coupling mechanism for electrically and/or mechanically coupling to a VRM 54. The electrical contact 128 may also be through hole mounted or surface mounted, and include features to accomplish such mounting to the VRM 54. The pressing surface 132 extends along the top 118 of, and from the rear 124 of, the main body 116. Optionally, the pressing surface 132 may extend from any portion of the rear 124 of the main body 116.

Figure 5:
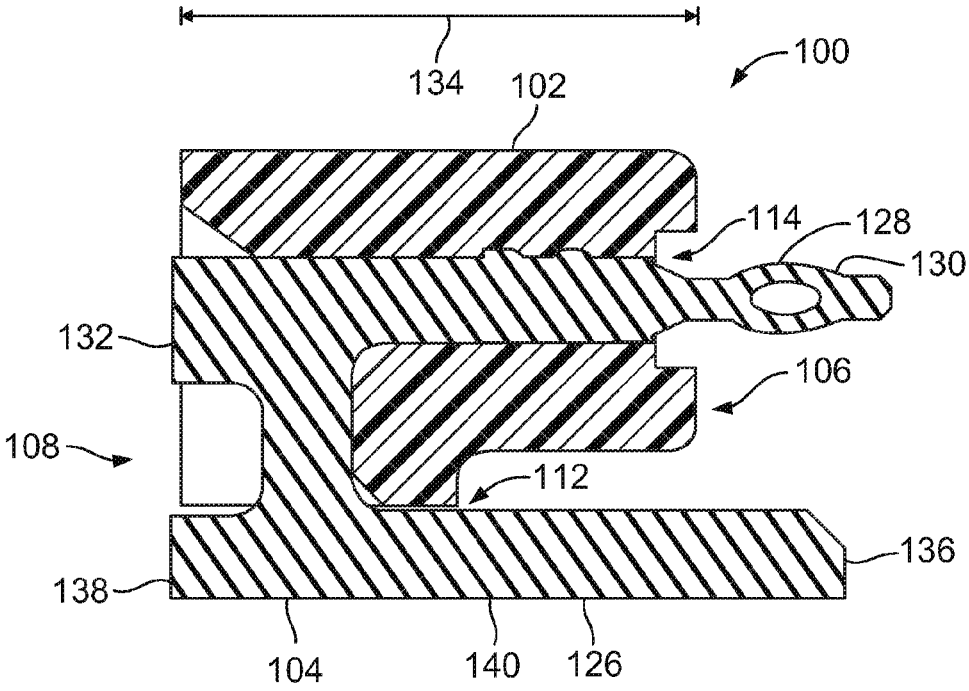
FIG. 5 is a side cross-sectional view of the connector shown in FIGS. 2 and 3.

FIG. 5 is a side cross-sectional view of the connector 100. The contact member 104 is inserted into the slot 114 to secure the contact member 104 within the housing 102. In the exemplary embodiment, the electrical contact 128 is secured within the slot 114. The electrical contact 128 extends through the slot 114 and, optionally, extends from the front 106 of the housing 102. The pressing surface 132 may extend past the rear 108 of the housing 102. In the exemplary embodiment, the pressing surface 132 extends approximately 0.01 to 0.015 inches from the rear 108 of the housing 102. Alternatively, the pressing surface 132 may be flush with the rear 108 of the housing 102 or recessed with respect to the housing 102.

The base 126 of the contact member 104 extends along the bottom 112 of the housing 102. The base 126 extends at least a depth 134 of the housing 102. In the exemplary embodiment, a front 136 of the base 126 extends past the front 106 of the housing 102 and a rear 138 of the base 126 extends past the rear 108 of the housing 102. The front 136 and the rear 138 of the base 126 may extend any suitable distance from the front 106 and the rear 108 of the housing 102. Optionally, the front 106 and the rear 108 of the housing 102 may extend past the front 136 and the rear 138 of the base 126, or the front 106 and the rear 108 of the housing 102 may be flush with the front 136 and the rear 138 of the base 126. The base 126 provides a planar surface 140 for supporting the connector 100 on the circuit board 52.

Figure 6:
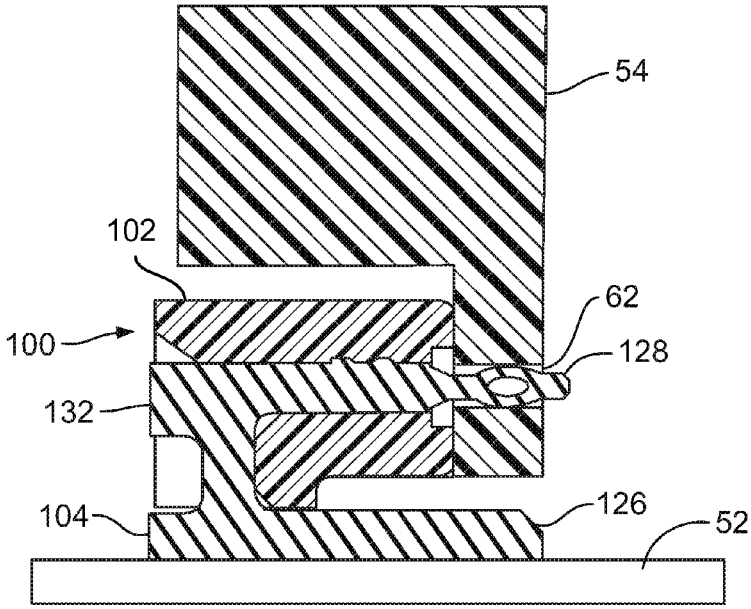
FIG. 6 is a side cross-sectional view of the connector shown in FIG. 5 coupled to the circuit board and the voltage regulator module shown in FIG. 1.

FIG. 6 is a side cross-sectional view of the connector 100 coupled to the circuit board 52 and the VRM 54. The base 126 of the contact member 104 is surface mounted to the circuit board 52. The base 126 may be soldered to the circuit board 52 and/or coupled using any suitable mechanism for securing electrical components. The housing 102 aligns the electrical contacts 128 of each contact member 104 in a co-planar relationship for coupling the VRM 54 to the connector 100. In an exemplary embodiment, the housing 102 aligns the electrical contact 128 to a minimum co-planarity of 0.004 inches per 2 inches.

The vias 62 of the VRM 54 are secured to the corresponding electrical contacts 128 of each contact member 104 so that the connector 100 provides an electrical interface between the circuit board 52 and the VRM 54 to enable power and/or data signals to be passed between the circuit board 52 and the VRM 54 through the contact members 104.

As the VRM 54 is connected to the electrical contacts 128, pressure may be applied to the pressing surface 132 of the contact members 104. The electrical contacts 128 are configured to provide a reduced interference fit in the vias 62 in order to minimize the force required to couple the VRM 54 to the connector 100. An amount of force transferred to the connector 100 is thereby reduced, alleviating connector twist and improving the co-planarity of the electrical contacts 128.

Figure 7:
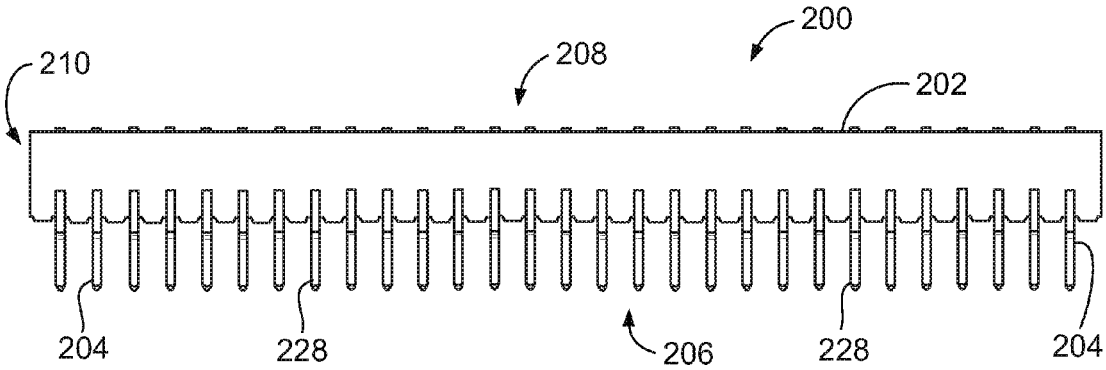
FIG. 7 is a top view of another connector that may be used with the electronic assembly shown in FIG. 1.

FIG. 7 is a top view of another connector 200 that may be used in place of the connector 56 shown in FIG. 1. Connector 200 has a housing 202 and a plurality of contact members 204. The connector 200 is configured to couple the VRM 54 to the circuit board 52. The housing 202 includes a front 206, a rear 208, a top 210, and a bottom 212 (shown in FIG. 8). The contact members 204 are secured within the housing 202. An electrical contact 228 of each contact member 204 extends from the front 206 of the housing 202.

Figure 8:
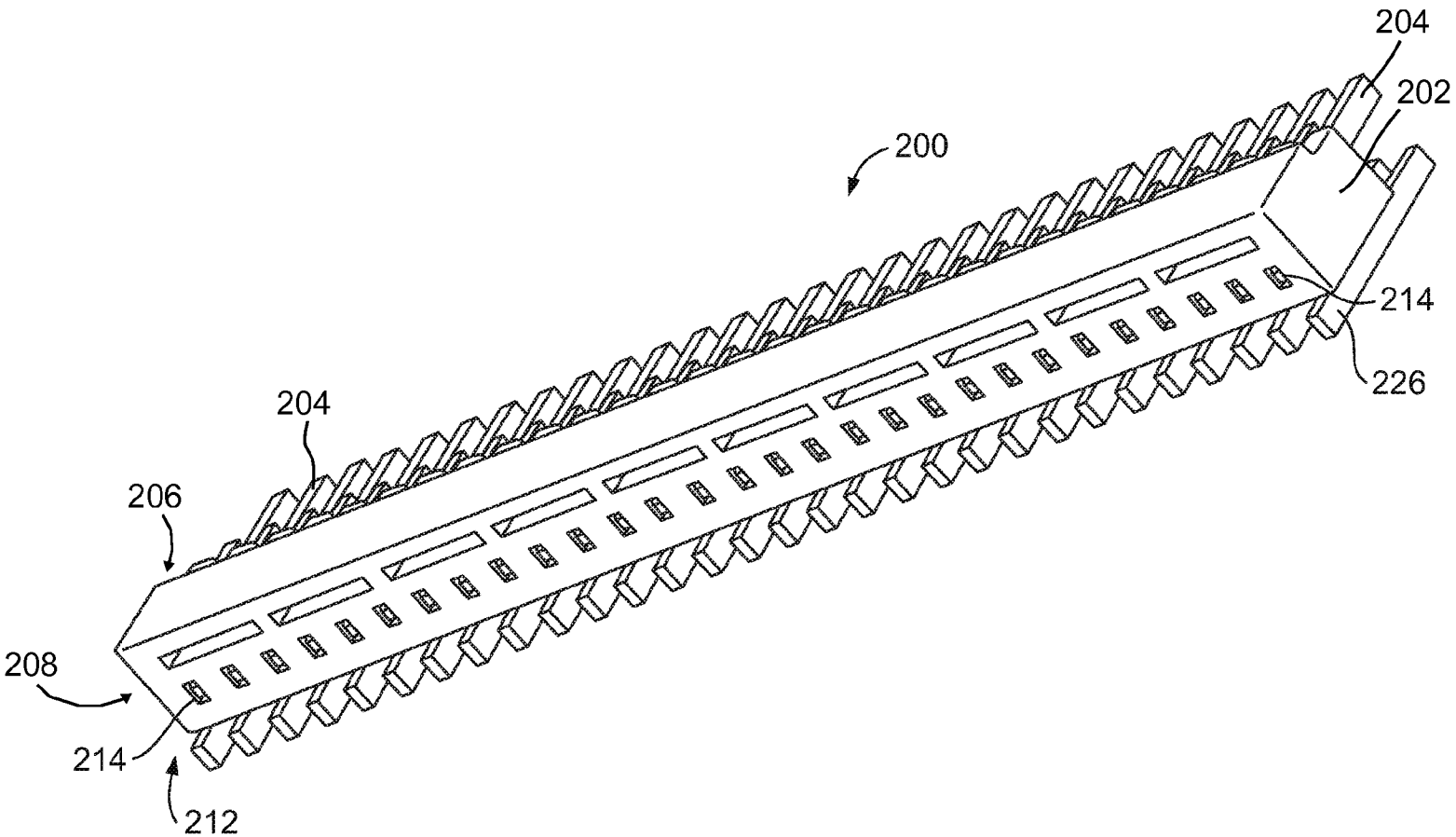
FIG. 8 is a rear perspective view of the connector shown in FIG. 7.

FIG. 8 is a rear perspective view of the connector 200. A base 226 of each contact member 204 extends along the bottom 212 of the housing 202. The connector 200 includes a plurality of slots 214 extending therethrough. The slots 214 extend from the front 206 of the housing 202 to the rear 208 of the housing 202. The contact members 204 are secured within the slots 214 to retain each contact member 204 within the housing 202. The housing 202 aligns the contact members 204 in a co-planar relationship.

Figure 9:
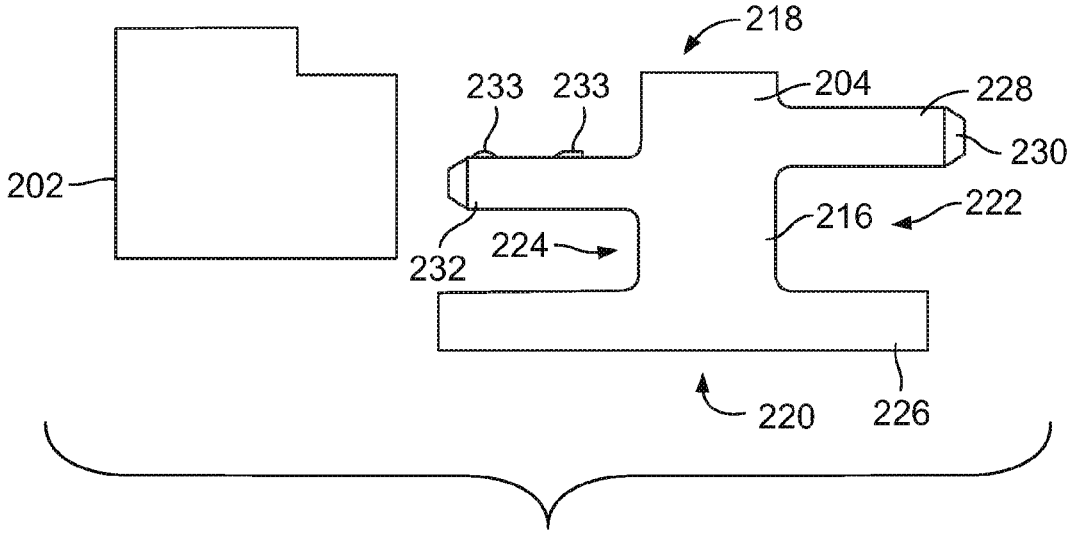
FIG. 9 is a side view of the housing and a contact member shown in FIGS. 7 and 8.

FIG. 9 is a side view of the housing 202 and a contact member 204. The contact member 204 includes a main body 216 having a top 218, a bottom 220, a front 222, and a rear 224. The base 226 extends along the bottom 220 of the main body 216. The base 226 extends from both the front 222 and the rear 224 of the main body 216. The electrical contact 228 extends from the front 222 of the main body 216, adjacent the top 218 of the body 216. Optionally, the electrical contact 228 may extend from any portion of the front 222 of the main body 216. In the exemplary embodiment, the electrical contact 228 is an elongated contact with a tapered end 230. Other types of contacts are possible in alternative embodiments. For example, the electrical contact 228 may be an eye-of-the-needle contact, a pin, a socket, a spring finger, a tab, a notch, and/or any other suitable coupling mechanism for electrically and/or mechanically coupling to the VRM 54. The electrical contact 228 may be through hole mounted or surface mounted and include features to accomplish such mounting to the VRM 54.

A protrusion 232 extends from the rear 224 of the main body 216. The protrusion 232 is configured to be received in the slot 214 (shown in FIG. 8) to secure the contact member 204 to the housing 202. In the exemplary embodiment, the protrusion 232 includes a pair of tabs 233 configured to provide an interference fit with the slot 214 of the housing 202. Optionally, the protrusion 232 may include an eye-of-the-needle contact, a pin, a socket, a spring finger, a notch, or any other suitable coupling mechanism.

Figure 10:
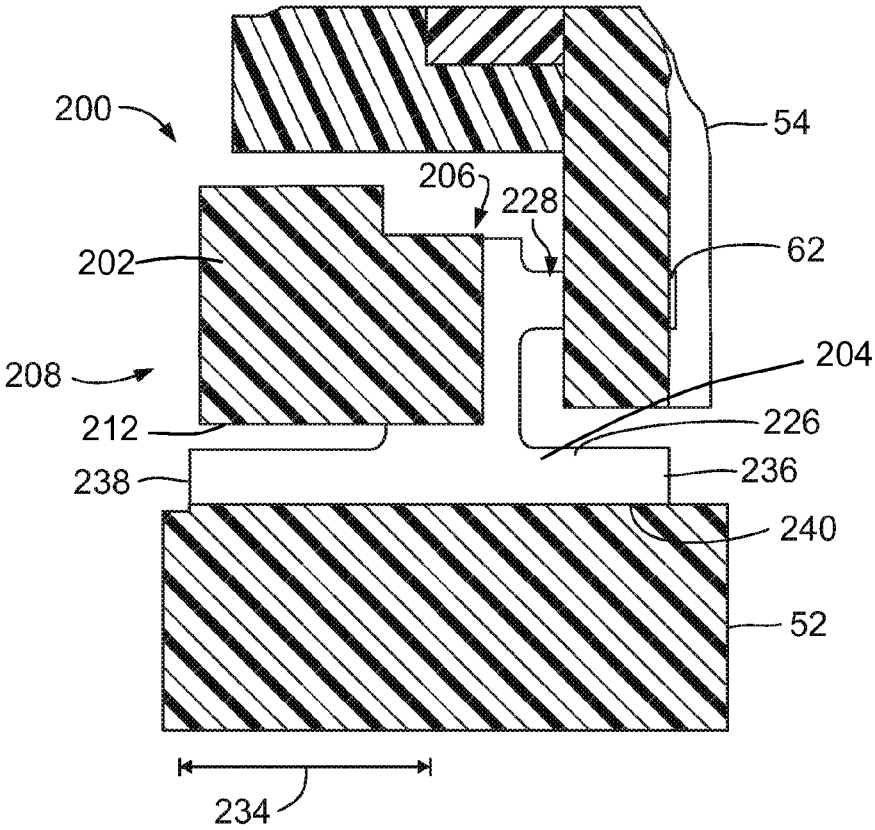
FIG. 10 is a side view of the connector shown in FIGS. 7 and 8 coupled to the circuit board and the voltage regulator module shown in FIG. 1.

FIG. 10 is a side cross-sectional view of the connector 200 coupled to the circuit board 52 and the VRM 54. The contact member 204 is inserted into the slot 214 (shown in FIG. 8) to secure the contact member 204 within the housing 202. In the exemplary embodiment, the protrusion 232 is secured within the slot 214. The electrical contact 228 extends from the front 206 of the housing 202.

The base 226 of the contact member 204 extends along the bottom 212 of the housing 202. The base 226 extends at least a depth 234 of the housing 202. In the exemplary embodiment, a front 236 of the base 226 extends past the front 206 of the housing 202 and a rear 238 of the base 226 extends past the rear 208 of the housing 202. The front 236 and the rear 238 of the base 226 may extend any suitable distance from the front 206 and the rear 208 of the housing 202. Optionally, the front 206 and the rear 208 of the housing 202 may extend past the front 236 and the rear 238 of the base 226, or the front 206 and the rear 208 of the housing 202 may be flush with the front 236 and the rear 238 of the base 226. The base 226 provides planar surface/surfaces 240 for supporting the connector 200 on the circuit board 52.

The base 226 of the contact member 204 is coupled to the circuit board 52. The base 226 may be soldered to the circuit board 52 and/or coupled using any suitable mechanism for securing electrical components. The housing 202 aligns the electrical contacts 228 of each contact member 204 in a co-planar relationship for coupling the VRM 54 to the connector 200. In an exemplary embodiment, the housing 202 aligns the electrical contacts 228 to a co-planarity of a minimum of 0.004 inches per 2 inches.

The vias 62 of the VRM 54 are secured to corresponding electrical contacts 228 of each contact member 204 so that the connector 200 provides an electrical interface between the circuit board 52 and the VRM 54 to enable power and/or data signals to be passed between the circuit board 52 and the VRM 54 through the contact members 204.

As the VRM 54 is connected to the electrical contacts 228, pressure may be applied to the rear 208 of the housing 202. The electrical contacts 228 are configured to provide a reduced interference fit in the vias 62 in order to minimize the force required to couple the VRM 54 to the connector 200. An amount of force transferred to the connector 200 is thereby reduced, alleviating connector twist and improving the co-planarity of the electrical contacts 228.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A connector for interconnecting a first and a second circuit board, the connector comprising:

contact members having:

a main body having a top, a bottom, a front, and a rear, a base extending along the bottom of the main body, the base being configured to be surface mounted to the first circuit board, the base extending outward from both the front and the rear of the main body, and an electrical contact extending forwardly from the main body, the electrical contact being configured to be through hole mounted to the second circuit board; and a housing having a top, a bottom, a front, and a rear, the housing further having slots formed therein, the contact members being secured in corresponding slots of the housing so that the bases of the contact members are held coplanar along the bottom of the housing for mounting to the first circuit board, the electrical contacts of the contact members extending from the front of the housing for mounting to the second circuit board.

2. The connector of claim 1, wherein the electrical contact of the contact member is secured within the slot so that the electrical contact extends through the housing.

3. The connector of claim 1, wherein the contact member further comprises a pressing surface extending from the rear of the main body, the pressing surface being configured to receive force for mounting the electrical contacts to the second circuit board.

4. The connector of claim 1, wherein the housing includes a depth extending between the front and the rear of the housing, the base extending along the housing at least the depth of the housing.

5. The connector of claim 1, wherein the base is substantially flush with the bottom of the housing.

6. The connector of claim 1, wherein the electrical contact is an eye-of-the-needle contact.

7. The connector of claim 1, wherein the contact members further have a protrusion extending from the rear of the main body, the protrusion secured within the slot of the housing.

8. The connector of claim 7, wherein the protrusion includes a tab for creating an interference fit with the housing.

9. A voltage regulator module (VRM) assembly comprising:

a VRM circuit board having vias;

a VRM component coupled to the VRM circuit board; and a connector comprising a housing having slots formed therein and contact members secured in corresponding slots of the housing, each contact member having an electrical contact being through hole mounted to a corresponding via in the VRM circuit board, each contact member having a base that is held coplanar to the base of at least one other contact member along a bottom of the housing for surface mounting to a motherboard, each contact member having a main body from which the base and the electrical contact extend, the base extending outward from both a front and a rear of the main body.

10. The VRM assembly of claim 9, wherein the electrical contacts extend from a front of the housing.

11. The VRM assembly of claim 9, wherein the electrical contacts are eye-of-the-needle contacts.

12. The VRM assembly of claim 9, wherein the electrical contacts are secured within a corresponding slot so that each electrical contact extends through the housing.

13. The VRM assembly of claim 9, wherein the housing includes a depth extending between a front and a rear of the housing, the base extending along the housing at least the depth of the housing.

14. The VRM assembly of claim 9, wherein the base extends beyond a bottom of the housing for surface mounting to the motherboard.

15. The VRM assembly of claim 9, wherein the contact members further include a protrusion extending therefrom, the protrusion secured within the slot of the housing.

16. The VRM assembly of claim 15, wherein the protrusion includes a tab for creating an interference fit with the housing.

17. An electronic assembly comprising:

a circuit board having electrical pads;

a voltage regulator module (VRM) including a VRM circuit board having vias and VRM components coupled to the circuit board; and a connector comprising a housing having slots formed therein and contact members secured in corresponding slots of the housing, each contact member having an electrical contact being through hole mounted to a corresponding via in the VRM circuit board, each contact member having a base that is held coplanar to the base of at least one other contact member along a bottom of the housing for surface mounting to the circuit board, each contact member having a main body from which the base and the electrical contact extend, the base extending outward from both a front and a rear of the main body.

18. The electronic assembly of claim 17, wherein the electrical contacts extend from a front of the housing.

19. The electronic assembly of claim 17, wherein each electrical contact is secured within a corresponding slot so that the electrical contacts extend through the housing.

20. The electronic assembly of claim 17, wherein the base extends beyond a bottom of the housing for surface mounting to the circuit board.

* * * * *